US009688372B2

(12) United States Patent
Debled

(10) Patent No.: US 9,688,372 B2
(45) Date of Patent: Jun. 27, 2017

(54) PROPULSION SAIL HAVING AN AIRCRAFT WING PROFILE

(71) Applicant: Antoine Debled, Lorient (FR)

(72) Inventor: Antoine Debled, Lorient (FR)

( * ) Notice: Subject to any disclaimer, the term of this patent is extended or adjusted under 35 U.S.C. 154(b) by 0 days.

(21) Appl. No.: 14/903,567

(22) PCT Filed: Jul. 7, 2014

(86) PCT No.: PCT/FR2014/000172
§ 371 (c)(1),
(2) Date: Jan. 7, 2016

(87) PCT Pub. No.: WO2015/004342
PCT Pub. Date: Jan. 15, 2015

(65) Prior Publication Data

US 2016/0167757 A1 Jun. 16, 2016

(30) Foreign Application Priority Data

Jul. 11, 2013 (FR) ..... 13 01642

(51) Int. Cl.
*B63H 9/04* (2006.01)
*B63H 9/06* (2006.01)

(52) U.S. Cl.
CPC ..... *B63H 9/0607* (2013.01)

(58) Field of Classification Search
CPC .. B63H 9/0607; B63H 9/0657; B63B 35/7983
USPC ..... 114/102.22, 102.23, 102.24, 102.29
See application file for complete search history.

(56) References Cited

U.S. PATENT DOCUMENTS 4,341,176 A * 7/1982 Orrison ..... B63H 9/0607 114/102.22
4,879,961 A * 11/1989 Aguilera ..... B63H 9/0614 114/102.22

FOREIGN PATENT DOCUMENTS

| | | |
|---|---|---|
| FR | 2 401 059 A1 | 3/1979 |
| FR | 2 431 425 A2 | 2/1980 |
| FR | 2 955 830 A1 | 8/2011 |
| GB | 2 231 854 A | 11/1990 |

* cited by examiner

*Primary Examiner* — Anthony Wiest
(74) *Attorney, Agent, or Firm* — Baker & Hostetler LLP

(57) ABSTRACT

A propulsion sail having an aircraft wing profile, comprises a traditional flexible sail and at least one detachable thickness module capable of being assembled in a detachable manner on a face of the flexible sail, wherein each module comprises at least one flexible plate, comprising a leading edge and a leech edge, the plate being assembled by its leading edge along the luff of the flexible sail via first assembly means and being assembled by its leech edge via second assembly means, the propulsion sail comprising at least one pair of modules, the two modules of the pair being disposed substantially symmetrically on either side of the flexible sail.

13 Claims, 3 Drawing Sheets

PROPULSION SAIL HAVING AN AIRCRAFT WING PROFILE

CROSS-REFERENCE TO RELATED APPLICATIONS

This application is a National Stage of International patent application PCT/FR2014/000172, filed on Jul. 7, 2014, which claims priority to foreign French patent application No. FR 1301642, filed on Jul. 11, 2013, the disclosures of which are incorporated by reference in their entirety.

FIELD OF THE INVENTION

The present invention relates to a propulsion sail and is aimed at endowing traditional propulsion sails on boats, sand yachts or flying wings with the aerodynamic properties of thick-profile aircraft wings, while at the same time respecting the limits on their use, stowage, the wind-dependent reduction in their sail area, reversal of their concavity according to the incident wind side relative to the operation of the boat.

BACKGROUND

Existing systems are currently encountering technical problems.

In the case of rigid thick profiles, the wing surface is difficult to modify.

Semi-rigid thick profiles use relatively complex mechanical systems which very often require special rigging (mast with several sail feeders) which do not always allow a reduction in sail area and stowage and which do not produce the intended effect of a thick sail (combination of two sails with issues surrounding retention of the thickness of the sail, for example). Patents FR 2 431 425 and FR 2 401 059 describe interesting semi-rigid thick profiles but the proposed devices are permanent and often require the creation of a new sail.

The applicant in patent FR 2 955 830 has likewise proposed detachable thickness modules for constructing a sail with an aircraft wing profile from a traditional flexible sail, one or several modules being capable of being assembled in a detachable manner on a face of the flexible sail. The modules are formed from one or several three-dimensional members assembled on the flexible sail.

SUMMARY OF THE INVENTION

The aim of the invention is to propose a new solution for forming a propulsion sail having an aircraft wing profile which has a simple design and is easy to implement.

To this end, the present invention proposes a propulsion sail having an aircraft wing profile, likewise referred to as a sail system, comprising a traditional flexible sail and at least one detachable thickness module, likewise referred to as a thickness volume module, capable of being assembled in a detachable manner on a face of the flexible sail, characterized in that each module comprises at least one flexible plate or sheet, substantially rectangular in shape, for example, comprising a leading edge and a leech edge, said plate being capable of being assembled in a detachable manner by its leading edge substantially along the luff of the flexible sail via first assembly means and being assembled in a detachable manner by its leech edge via second assembly means, said propulsion sail comprising at least one pair of modules, the two modules of said pair being disposed substantially symmetrically on either face of the flexible sail, one module being assembled on each face of the flexible sail.

A device is proposed according to the invention for constructing from a standard sail a sail having an aircraft wing profile with reversible concavity, allowing the aerodynamic performance to be improved while respecting the customary functions of the so-called traditional sail. The present invention involves a refinement of the aforementioned patent FR 2 955 830.

Flexible plates of this kind according to the invention allow thickness modules to be created which have a simple design and are easy to implement. The use of at least one pair of modules facing each other allows a thick profile to be created on either side of the sail which is reversible according to the incidence of the wind.

Following the dimensions of the sail and/or the zones of the sail where it is hoped to add thickness, the sail comprises a single pair of modules or several pairs of modules assembled one above the other.

Moreover, each plate extends from the luff over a section of the chord or over the totality of the chord up to the leech. By way of example, each plate extends over 40% of the chord and generates around 6% of the chord in thickness, so 12% for a pair of plates.

The invention enables the surface and power of the sail to be reduced or increased by affixing modules to it or partially removing them from it. It is then possible to reef the liberated section. Reefing takes place in the same way as on a traditional sail by lowering of the head, new tack point, new clew.

According to one embodiment, each module further comprises at least one insert placed between the flexible plate and the flexible sail when said plate is assembled on said flexible sail and capable of moving said plate away from the face of the sail. According to the invention, one or several inserts are introduced between the sail and the plates to increase and/or adjust the thickness of each module. The use of inserts of this kind allows thin plates to be used which are therefore lower in weight and easier to stow when the sail is not in use.

According to one embodiment, said second assembly means are capable of allowing a relative translatory movement of the flexible plate in relation to the flexible sail in a substantially perpendicular direction to the luff of the flexible sail. This freedom of movement of the plates allows the sail profile to be adapted depending on the incident wind edge relative to the operation of the boat, without deforming the flexible sail.

According to one embodiment, each flexible plate is formed from a foam plate, for example polyethylene foam. According to another embodiment, each flexible plate is formed from a semi-rigid plastic material.

According to one embodiment, each insert is formed from a tube, preferably of foam, and preferably disposed substantially parallel to the luff of the flexible sail, substantially vertically, between a flexible plate and the sail. Apart from the simplicity with which they are implemented, the foam plates and/or the foam inserts offer floatability and allow the risks of capsizing to be limited if not eliminated.

According to another embodiment, each insert is formed from an inflatable structure.

According to one embodiment, each insert is assembled on a flexible plate and/or on the flexible sail via connection means, such as Velcro-type systems.

According to one embodiment, the sail comprises first assembly means and/or second assembly means capable of simultaneously assembling flexible plates of a same pair, disposed on either side of the flexible sail.

According to one embodiment, said first and/or second assembly means comprise one or several assembly parts, each assembly part comprising a central tube and two side tubes connected to one another, such that the side tubes can be positioned in an assembly position in which the central tube and the side tubes are substantially aligned or parallel and an assembly position in which the side tubes are positioned substantially perpendicularly to the central tube, said assembly part, with its side tubes in the assembly position, being capable of being inserted into a hole or port in a first plate of a pair of modules, an eyelet in the flexible sail and a hole or port in the second plate of the pair of modules, for example by means of a mounting rod inserted in the internal passages of the tubes and of holding the two plates on the sail when its two side tubes are in the assembly position, each one against the outer face of a flexible plate. An assembly part of this kind allows an operator to assemble two plates facing one another remaining on a same side of the sail.

According to one embodiment, the second assembly means comprise one or several assembly parts, each assembly part being capable of passing along a horizontal port in the flexible plates, disposed substantially perpendicularly to the luff, to allow said translatory movement.

According to one embodiment, the central tube and the two side tubes of an assembly part are connected to one another by an elastic band passing along the internal passage of the central tube, the ends whereof are assembled on the side tubes, preferably in the middle thereof, the elastic link tensioning said side tubes in their assembly position. According to one variant, the central tube and the side tubes are connected by a portion with a smaller cross section forming a hinge and allowing the side tubes to be moved between their two positions, the assembly parts being capable of being formed from a single piece, for example of molded or injected plastic, or from two single pieces each comprising a side tube connected to a central tube section by a portion with a smaller cross section, the two one-piece parts being assembled one on the other directly or by inserting one or several struts to form central tubes of different lengths.

According to one embodiment, the flexible sail comprises sliding pieces along the luff, for assembly thereof to a mast, said sail comprising one or several corner pieces, each corner piece being capable of being mounted vertically between two sliding pieces between the mast and the modules.

According to one embodiment, the sail comprises intermediate assembly means capable of assembling each plate to the flexible sail between the first assembly means and the second assembly means, in particular between the inserts and the second assembly means, said intermediate assembly means preferably being capable of allowing a relative translatory movement of the flexible plate in relation to the flexible sail in a perpendicular direction to the luff of the flexible sail.

According to one embodiment, said sail comprises pre-positioning means to allow a pre-positioning of the plates before their assembly with the first and second assembly means. These pre-positioning means may comprise Velcro-type systems in one or several hook/loop strips preferably disposed substantially vertically on the plates and on the flexible sail.

BRIEF DESCRIPTION OF THE DRAWINGS

The invention will be easier to understand and other aims, details, characteristics and advantages will appear clearer from the detailed explanatory description which follows of a particular currently preferred embodiment of the invention, with reference to the attached schematic drawings in which.

DETAILED DESCRIPTION

Figure 1:
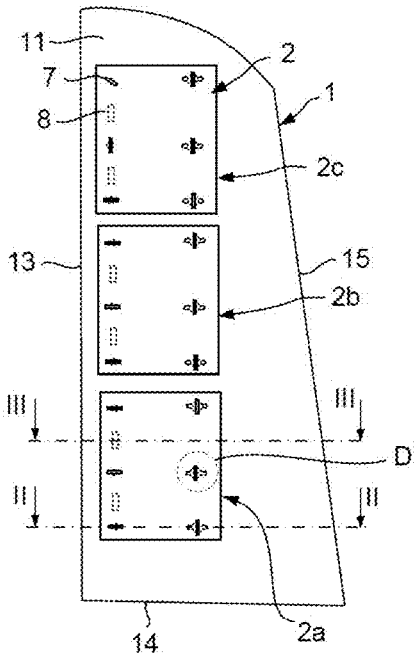
FIG. 1 is a schematic side view of a sail according to the invention.
Figure 2:
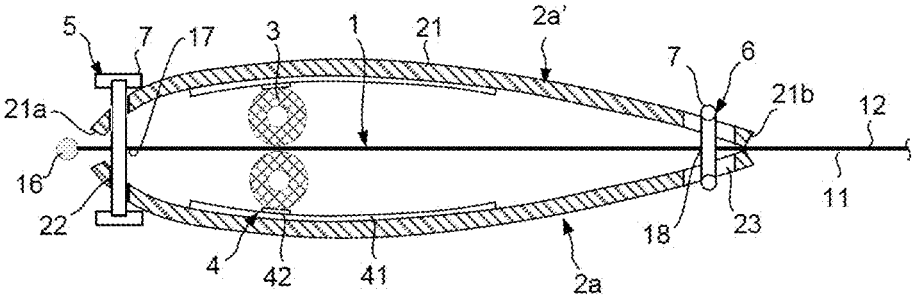
FIG. 2 is an enlarged partial view through the sectional plane II-II in FIG. 1.

With reference to FIGS. 1 and 2, the propulsion sail having an aircraft wing profile comprises a flexible sail 1, described as traditional, formed for example by Dacron cloths assembled one to the other and comprising a luff 13, a foot 14 and a leech 15. The sail here is provided with a bolt rope 16 along the luff to assemble it to the groove in the mast. According to the invention, the sail 1 further comprises thickness modules, designated with the general reference number 2, positioned on each of its faces 11, 12 of the sail. In the embodiment illustrated, the sail comprises on each face 11, 12 three superposed modules, referred to as 2*a*, 2*b*, 2*c* in FIG. 1. The sail comprises three pairs of two modules, the two modules in each pair being disposed facing one another, substantially symmetrically on either side of the flexible sail 1. FIG. 2 illustrates the two modules 2*a*, 2'*a* facing one another in a pair.

Each module 2 comprises a flexible sheet or plate 21, for example a foam sheet, placed on a face of the sail 1 and one or several inserts 3 placed between the plate and the sail, depending on the intended thickness and profile. Each insert 3 is formed from a foam tube.

The sail comprises connection means 4 for connecting the inserts 3 to the plates 21 here and assembly means 5, 6 for assembling plates on each face of the sail.

The connection means here are formed from a Velcro-type system 4, for example with one or several hook sections in the form of strips disposed on the inner face of the plates, and one or several loop sections in the form of strips disposed on the inserts. By way of example, hook strips 41 are fixed substantially horizontally on the inner face of the plates 21, preferably at least two strips staggered vertically one in respect of the other. Each insert is provided with a loop strip 42 extending longitudinally along the insert.

Each plate 21 exhibits an edge referred to as the leading edge 21*a* and an opposite edge referred to as the leech edge 21*b*. For each plate, first assembly means 5 are provided to assemble the leading edge 21*a* on the sail 1, along the luff 13, and second assembly means 6 are provided to assemble the leech edge 21*b* on the sail. In the present embodiment, these first and second assembly means comprise assembly parts 7.

Figure 5A:
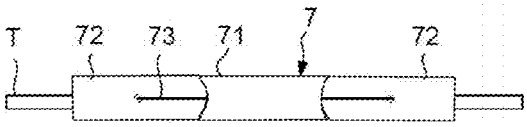
FIGS. 5A and 5B are schematic side views of an assembly part in the mounting position and in the assembly position, respectively.
Figure 5B:
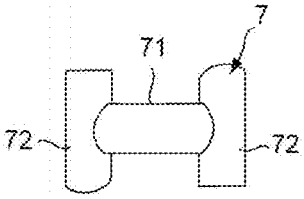

With reference to FIGS. 5A and 5B, this assembly part 7 is formed from a central tube 71 and two side tubes 72 connected to one another by an elastic link 73. The elastic link passes along the internal passage of the central tube 71 and each end of the link is assembled on a side tube 72, substantially in the middle of the side tube. The side tubes are elastically tensioned by the elastic link in a position referred to as the assembly position, as illustrated in FIG. 5B, in which the side tubes are positioned substantially perpendicularly to the central tube. In order to guarantee this perpendicular positioning, the end edges of the central tube advantageously exhibit two opposite concave notches in which the side tubes are positioned in an assembly position, to carry out what is referred to as a tongue-and-groove assembly. By passing a T-shaped mounting rod or needle along the internal passages of the two tubes and the central tube, the side tubes can be brought into what is referred to as a mounting position, as illustrated in FIG. 5A, in which the tubes 71, 72 are substantially aligned.

The first assembly means 5 in this case comprise three assembly parts 5 staggered vertically in respect of one another, each assembly part allowing simultaneous assembly on the sail of the two modules in a pair facing one another. Each assembly part passes along a circular port or hole 22 in the plate of each module and along an eyelet 17 in the sail. The assembly part 7 with its side tubes held in the mounting position via a T-shaped needle is inserted in the port 22 of a first plate 2*a* of a module pair, the eyelet 17 of the flexible sail and the port 22 of the second plate 2'*a* of the module pair. When the central tube has passed the port of the second plate, the operator can withdraw the needle, the side tubes return elastically into the assembly position.

Figure 6:
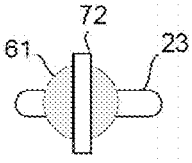
FIG. 6 is an enlarged view of the detail D in FIG. 1.

The second assembly means 6 likewise comprise three assembly parts 7, each passing as previously along a hole or port 23 proximate to the leech edge of each plate and along an eyelet 18 in the sail. The ports 23 are horizontal, preferably oblong, ports, extending horizontally substantially perpendicularly to the luff 13, so as to allow a movement of the plates in relation to the sail for an automatic adaptation of the profile depending on the angle of incidence of the wind. These horizontal ports may be reinforced by sticking a reinforcement to their perimeter, such as an assigna-type adhesive sail strip. With reference to FIG. 6, a spring washer 61 is preferably then mounted on the central tube between each side tube and the plate, to prevent the assembly part from being accidentally withdrawn if one of the side tubes is positioned parallel to the horizontal ports.

Figure 3:
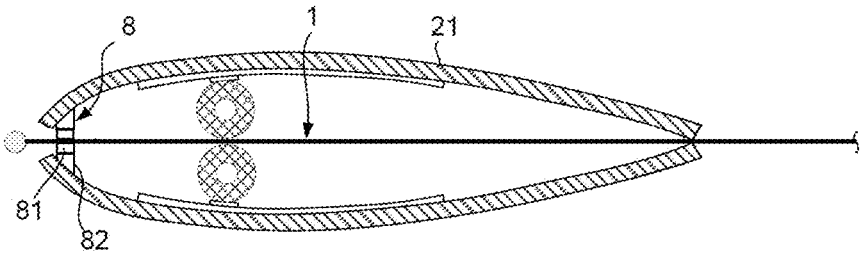
FIG. 3 is an enlarged partial view through the sectional plane III-III in FIG. 1 illustrating the pre-positioning means.

Advantageously, with reference to FIG. 3, pre-positioning means 8 are provided along the luff 13 to help the positioning of the plates 21. These means are, for example, made of Velcro with hook sections or strips 81 and loop sections 82 provided on the sail and the plates.

As an illustrative example, each plate is formed from a polyethylene foam plate, measuring around 10 mm thick and with a density of 33 kg/m$^3$, for example, marketed under the trading name of Plastazote, thickened thanks to inserts formed from foam tubes in the manner of insulating sleeves traditionally used in the insulation field, with a diameter of 50, 60 or 80 mm, for example.

The kinematics for use of the configuration by the crew is as follows.

The sails concerned are in position and ready to be hoisted. The principle is to apply pairs of modules to their surface where the thickness is needed, depending on the sailing speeds chosen by the crew. As the sail is gradually hoisted, the plates 21 of the modules are pre-positioned thanks to the Velcro 8 on the sail and on the plates, then assembled on the sail thanks to assembly parts 7 which cross the eyelets 17 along the luff and the holes 22 along the leading edge of the plates. Other assembly parts cross the horizontal ports 23 on the rear part of the plates and the eyelets 18 on the sail. The inserts 3 are placed between the plates and the sail and held in place thanks to Velcro 4. Once the sail is set, it exhibits a thick section along the luff which increases its performance.

Figure 4A:
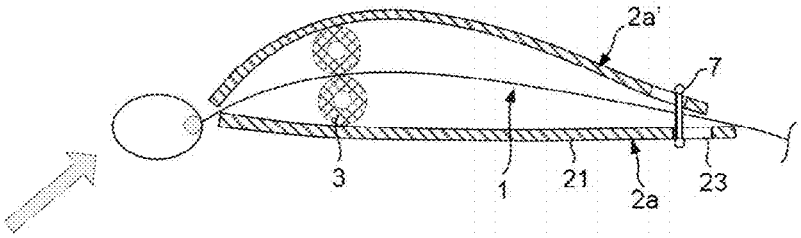
FIGS. 4A and 4B represent sectional views similar to that in FIG. 2, illustrating the principle of automated asymmetry.
Figure 4B:
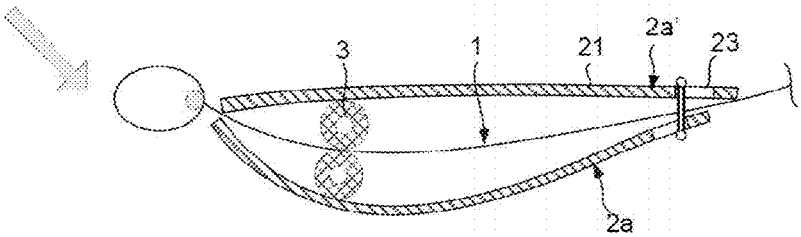

If a side to side transfer is needed, the sail reacts like a traditional sail and naturally, thanks to the use of the initial belly of the flexible sail, the transfer of lower/upper volumes takes place automatically, as illustrated in FIGS. 4A and 4B, the horizontal ports 23 allowing the movement of the plates 21.

In order to regulate the power of the thick sail, the effect of removing the thickness modules is to return the sail to its original configuration to allow reefing in the traditional manner. The unused thickness modules will be stored on or in the boat.

In order to regulate the thickness of the thick sail, it is possible to add one or several inserts and to position them as desired along the loop strips 41.

Figure 7:
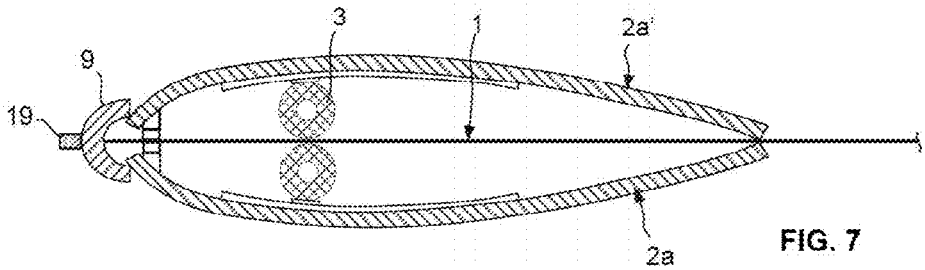
FIG. 7 depicts a detachable corner piece on the sail with sliding pieces.

With reference to FIG. 7, when the flexible sail is equipped with sliding pieces 19 to assemble it to the mast, instead of a bolt rope, detachable corner pieces 9 are placed on the luff of the sail between the sliding pieces, said corner pieces providing the transition between the thick profile of the mast and the thick profile of the modules. These corner pieces have a general U-shaped section, the base of the U being disposed on the side of the sliding pieces and the legs of the U being oriented towards the rear and extending the plates 21 or covering the leading edges thereof.

The detachable thickness modules above, as well as those following implementation can be applied to the sails of sailing boats or any other vessel propelled by the force of the wind by means of sails or wings and to all sails, strictly speaking, without this requiring any modification to the customary rigging. They will be able to be marketed in kit form, depending on the existing sails.

Figure 8:
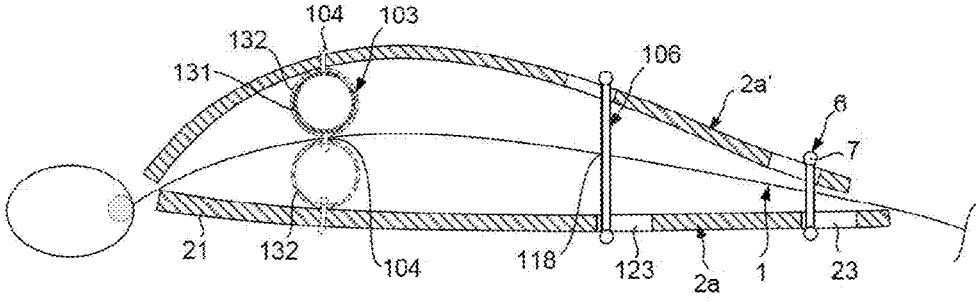
FIG. 8 is a similar view to that in FIG. 4A illustrating a variant.

FIG. 8 illustrates a variant in which the inserts 103 are of an inflatable type and comprise an inflatable pocket 131 placed in a casing 132 through which the insert is connected to the sail or to a plate by connecting means 104. These connecting means are formed from assembly parts 104 similar to those described previously, passing through openings in the casing, in the sail and/or the plates, possibly obtained from tubes with a smaller cross section, as illustrated in FIG. 8. The inflatable pocket of one of the two inserts has been left out of FIG. 8, in order to better illustrate these connection means. Assembly parts 104 are used for simultaneously assembling the casings 132 of the two inserts on either side of the sail and assembly parts are used to connect each casing to a plate. According to one embodiment, each inflatable insert extends over substantially the entire height of the sail and is assembled by its casing on different plates. Once the sail has been hoisted, the pocket is inflated via a valve present in the lower section. The insert exhibits a globally conical form with a section that varies depending on the chord of the sail. This variable section is advantageously obtained via a casing, the cross section whereof diminishes from the bottom upwards.

Intermediate assembly means 106 for assembly of the plates 21 on the sail are, moreover, provided between the inserts 104 and the second assembly means 6, in order to guarantee that the profile is maintained. These secondary assembly means are formed from assembly parts 107 similar to those 7 used for the second assembly means with central tubes of a greater length. These assembly parts cross horizontal ports 123 on the plates and the eyelets 118 on the sail.

According to another variant, the first assembly means are formed by a zip closing system traditionally referred to as a zip closure, having for each plate a strip provided with teeth assembled on the sail and a strip provided with teeth assembled on the plate.

Although the invention has been described in connection with a particular embodiment, it is quite clear that it is in no way limited to this and that it comprises all the technical equivalents of the means described, as well as combinations thereof if these fall within the scope of the invention.

The invention claimed is:

1. A propulsion sail having an aircraft wing profile, comprising a flexible sail and at least one detachable thickness module capable of being assembled in a detachable manner on a face of the flexible sail, wherein each module comprises at least one flexible plate, comprising a leading edge and a leech edge, said plate being capable of being assembled by the leading edge along a luff of the flexible sail via a first assembly means and being assembled by the leech edge via a second assembly means, said propulsion sail comprising at least one pair of modules, the two modules of said pair being disposed substantially symmetrically on either face of the flexible sail.

2. The sail as claimed in claim 1, wherein each module further comprises an insert placed between the flexible plate and the flexible sail and capable of moving said plate away from the face of the sail.

3. The sail as claimed in claim 2, wherein each insert is formed from a foam tube disposed substantially parallel to the luff of the flexible sail, between the flexible plate and the flexible sail.

4. The sail as claimed in claim 2, wherein each insert is formed from an inflatable structure.

5. The sail as claimed in claim 2, wherein each insert is assembled on the flexible plate and/or on the flexible sail via connection means.

6. The sail as claimed in claim 1, wherein said second assembly means are capable of allowing a relative translatory movement of the flexible plate in relation to the flexible sail in a substantially perpendicular direction to the luff of the flexible sail.

7. The sail as claimed in claim 6, wherein the second assembly means comprise one or several assembly parts, each assembly part being capable of passing along a horizontal port in the flexible plates to allow said translatory movement.

8. The sail as claimed in claim 1, wherein each flexible plate is formed from a foam plate.

9. The sail as claimed in claim 1, comprising first assembly means and/or second assembly means capable of simultaneously assembling flexible plates of a same pair, disposed on either face of the flexible sail.

10. The sail as claimed in claim 9, wherein said first and/or second assembly means comprise one or several assembly parts, each assembly part comprising a central tube and two side tubes connected to one another, such that the side tubes can be positioned in a mounting position in which the central tube and the side tubes are substantially aligned or parallel and an assembly position in which the side tubes are positioned substantially perpendicularly to the central tube, said assembly part, with its side tubes in the mounting position, being capable of being inserted into a port in a first plate of a pair of modules, an eyelet in the flexible sail and a port in the second plate of the pair of modules and of holding the two plates when its two side tubes are in the assembly position, each one against the outer face of a flexible plate.

11. The sail as claimed in claim 10, wherein the central tube and the two side tubes of an assembly part are connected to one another by an elastic link passing along an internal passage of the central tube, the elastic link having ends which are assembled on the side tubes, the elastic link tensioning said side tubes in their assembly position.

12. The sail as claimed in claim 1, wherein the flexible sail comprises sliding pieces along the luff, said sail comprising one or several corner pieces, each corner piece being capable of being mounted vertically between two sliding pieces between a mast and the modules.

13. The sail as claimed in claim 1, comprising intermediate assembly means capable of assembling each flexible plate to the flexible sail between the first assembly means and the second assembly means.

* * * * *